US005727365A

United States Patent [19]

Lashyro et al.

[11] Patent Number: 5,727,365

[45] Date of Patent: Mar. 17, 1998

[54] APPARATUS FOR PACKAGING ARTICLE GROUPS

[75] Inventors: Jeffrey A. Lashyro; Kelly W. Ziegler, both of Crosby, Minn.

[73] Assignee: Riverwood International Corporation, Atlanta, Ga.

[21] Appl. No.: 586,408

[22] Filed: Jan. 16, 1996

[51] Int. Cl.[6] ..... B65B 35/30; B65B 35/50

[52] U.S. Cl. ..... 53/448; 53/157; 53/230; 53/240; 53/252; 53/445; 53/447; 53/474; 53/475; 53/540; 53/543

[58] Field of Search ..... 198/419.1; 53/48.1, 53/154, 155, 156, 157, 237, 238, 240, 244, 250, 251, 252, 445, 447, 448, 458, 474, 475, 537, 540, 566, 542, 543

[56] References Cited

U.S. PATENT DOCUMENTS

| | | | |
|---|---|---|---|
| 1,874,669 | 8/1932 | Wagner | 53/250 |
| 2,050,547 | 8/1936 | Thayer | 53/448 X |
| 2,918,765 | 12/1959 | Currivan | 53/251 X |
| 2,971,309 | 2/1961 | Miskel et al. | 53/240 |
| 3,201,912 | 8/1965 | Wozniak | 53/537 X |
| 3,210,904 | 10/1965 | Banks | 53/475 X |
| 3,323,281 | 6/1967 | Talbot | 53/542 X |
| 3,483,668 | 12/1969 | Frost et al. | 53/252 X |
| 3,579,956 | 5/1971 | Hoffmann | 53/540 |
| 3,826,058 | 7/1974 | Preisig | 53/475 X |
| 3,941,236 | 3/1976 | Hagedorn | 53/537 X |
| 3,979,878 | 9/1976 | Berney | 53/543 X |
| 4,041,677 | 8/1977 | Reid | 53/543 |
| 4,385,482 | 5/1983 | Booth | 53/240 X |
| 4,421,229 | 12/1983 | Pan et al. | 206/602 X |
| 4,555,892 | 12/1985 | Dijkman | 53/154 X |
| 4,611,705 | 9/1986 | Fluck | 53/542 X |
| 4,768,329 | 9/1988 | Borrow | 53/543 |
| 4,802,324 | 2/1989 | Everson . | |
| 4,815,251 | 3/1989 | Goodman | 53/238 X |
| 5,036,644 | 8/1991 | Lahsyro et al. . | |
| 5,070,992 | 12/1991 | Bonkowski | 53/543 X |
| 5,241,806 | 9/1993 | Ziegler et al. . | |
| 5,456,058 | 10/1995 | Ziegler . | |
| 5,457,940 | 10/1995 | Ziegler et al. . | |

OTHER PUBLICATIONS

Pillsbury —Mead Machine #1225 Videotape (Mar. 1, 1996).

APV Douglas Machine M-2207 Continuous Motion Wrap around Case Packer (Aug. 24, 1990).

*Primary Examiner*—Daniel Moon

*Attorney, Agent, or Firm*—Skinner And Associates; Joel D. Skinner, Jr.; Steve M. McLary

[57] ABSTRACT

A method for packaging flat or stacked article groups within a packaging unit such as a paperboard carton. The method comprises the steps of supplying a stream of packaging units, for example paperboard cartons, supplying at least one stream of articles, for example beverage cans; forming at least one article group, for example a group of from six to twenty-four cans, optionally placing a support base on a top surface of the article group, and loading the article group in the packaging unit. In a stacked packaging mode a second article group is formed and loaded into the packaging unit, on top of the support base on each first article group disposed in the packaging unit. An apparatus for implementing the method is also disclosed.

12 Claims, 8 Drawing Sheets

APPARATUS FOR PACKAGING ARTICLE GROUPS

STATEMENT REGARDING FEDERALLY SPONSORED RESEARCH AND DEVELOPMENT

Not Applicable.

CROSS-REFERENCE TO RELATED APPLICATIONS

Not applicable.

BACKGROUND OF THE INVENTION

1. Field of the Invention

This invention relates to packaging methods and apparatus. Particularly, this invention relates to an apparatus and method for packaging flat and stacked groups of articles into carrying cartons. The apparatus and method are particularly well suited for packaging relatively large groups of small articles in stacked configurations into paperboard cartons.

2. Background of the Invention

Prior art packaging machines include U.S. Pat. No. 4,802,254 to applicants' assignee for a Vertical Cartoning Assembly and Method which discloses the assembly of cartons for pre-selected article groups being moved on a conveyor. U.S. Pat. No. 5,036,644, also to applicants' assignee, discloses a Packaging Sleever Assembly which transfers flat packaging sleeves directly onto pre-selected article groups and subsequently wraps and closes the cartons. U.S. Pat. No. 5,241,806, also to applicants' assignee, discloses a Continuous Motion Cartoner Assembly which loads article groups into open ended carton sleeves. Additionally, applicants' assignee manufactures Twin Stack® Packaging Machines which form stacked article groups and subsequently load the groups into open ended carton sleeves.

It is an object of this invention to provide an apparatus and method for reliably packaging products in a wide range of flat or stacked group sizes and configurations. Another object of this invention is to provide a packaging apparatus and method which are usable with a variety of package types and sizes, article types and sizes, and group configurations (stacked and unstacked) and sizes. Another object is to provide an apparatus which is low in cost. Another object is to provide an apparatus which is compact. Another object is to provide an apparatus which is optimized for packaging relatively large groups of relatively small articles.

BRIEF SUMMARY OF THE INVENTION

The apparatus of the present invention provides a method and apparatus for packaging articles. The method comprises the steps of supplying a stream of packaging units, for example paperboard cartons; supplying at least one input stream of articles, for example beverage cans, substantially perpendicularly with respect to the stream of packaging units; forming a flat, single layer article group at a terminal end of the input stream of articles, the article group having a plurality of articles in a predetermined configuration for example a 3×4 group of 12; and substantially perpendicularly loading the article group into a packaging unit in the stream of packaging units. Preferably, pair of input streams of articles are supplied, a second input stream of articles being activatable for loading a second flat, single layer article group into the packaging unit, on top of the first article group disposed therein, whereby stacked article groups, for example a group of 24, are formed in the packaging unit. In a stacking mode, a divider sheet, for example a paperboard panel, is optionally placed on top of the first article group prior to its being loaded in the packaging unit, and the second article group is slid across the divider sheet.

The packaging apparatus basically comprises a central, longitudinally oriented, linear carton line; a first or low article infeed line; an optional second or high article infeed line; an optional divider sheet feeder; a low group selecting and loading assembly; and an optional high group selecting and loading assembly. The carton stream is disposed longitudinally and extends downstream to an output end. The article infeed streams are oriented laterally and approach the same side of the carton stream. The infeed lines are staggered longitudinally along the carton line, the high infeed line being disposed downstream with respect to the low line, and further, at a higher vertical level than the low line.

In operation, carton blanks are erected into open ended cartons on the carton line. Unmetered articles on the input lines are formed into groups and loaded into erected cartons. For stacked packaging, the low group selecting and loading assembly forms a low article sub-group and loads it into a carton on the carton line. The high group selecting and loading assembly forms a high article sub-group and loads it into the carton containing the low article sub-group. The high article sub-group is slid over the low article sub-group resident in the carton, preferably over a divider sheet disposed thereon, to form a stacked article group inside the carton. In a flat or single tier article group processing mode, only the low article input line is operational. The low group selecting and loading assembly forms the single level article group and loads it into a carton on the carton line.

The features, benefits and objects of this invention will become clear to those skilled in the art by reference to the following description, claims and drawings.

DETAILED DESCRIPTION

The methods and apparatus of the present invention are for packaging articles such as beverage cans in a compact operation. The apparatus is adjusted or changed over to provide reliable packaging of articles or products of varying types, and sizes, in a variety of group sizes and configurations, into packages of varying types and sizes. For example, the apparatus is usable to load beverage cans into a variety of single level and two level or tier (stacked) pack combinations, from six to forty-eight cans, into paperboard cartons or carriers. The apparatus and method are particularly well suited for processing relatively large groups of relatively small products as in the case of the stacked, forty eight pack. Packaging is accomplished quickly and reliably, under typical industry tolerances for both beverage can and canon construction. Although the embodiments disclosed load beverage can groups into paperboard canons, its within the purview of this invention to process articles of a variety of types and sizes and containing a variety of products such as liquids, semi-solids and solids, into a variety of packaging media.

Figure 1:
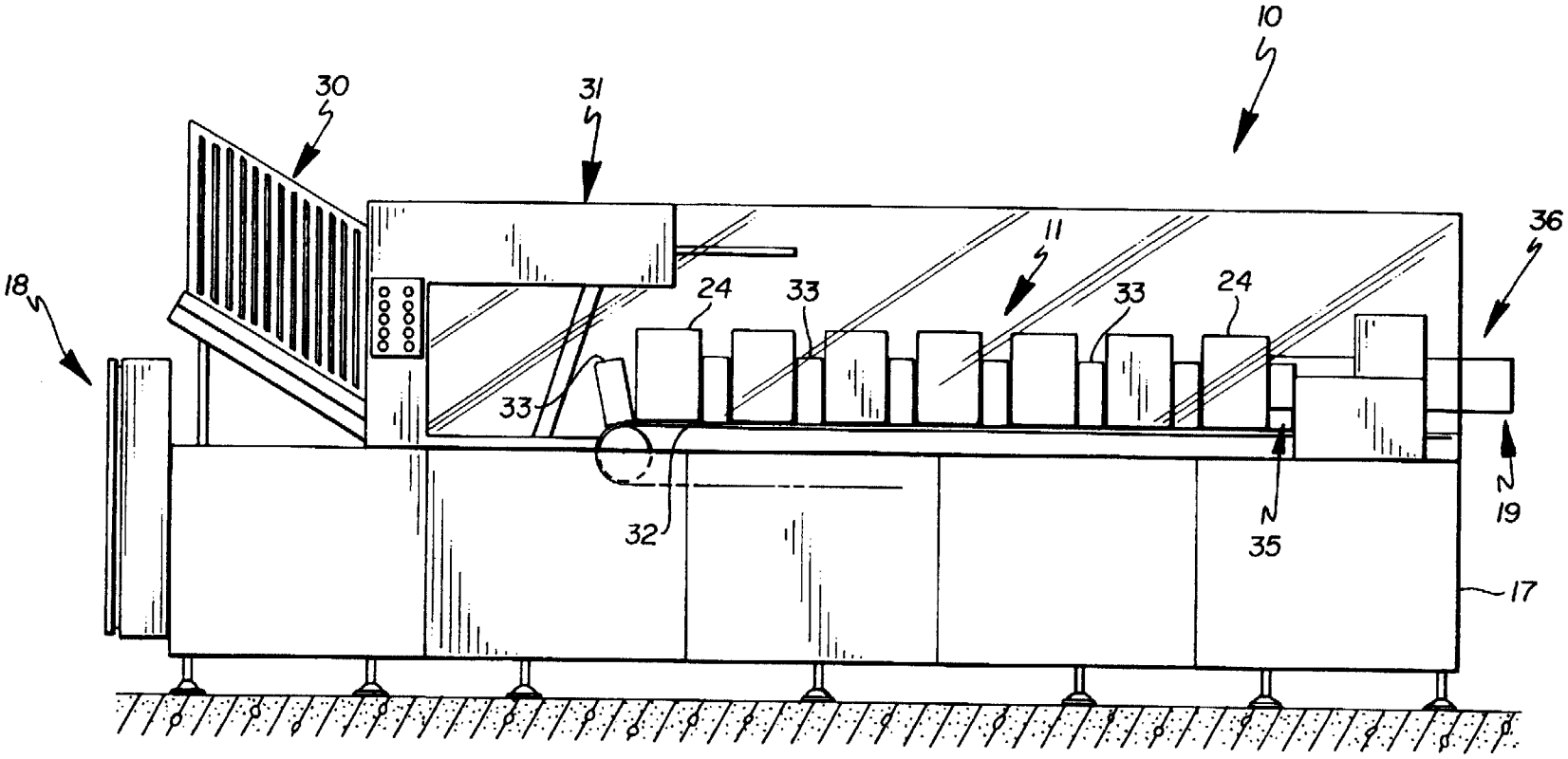
FIG. 1 is a side or elevation view of a preferred embodiment of the apparatus of the present invention.
Figure 2:
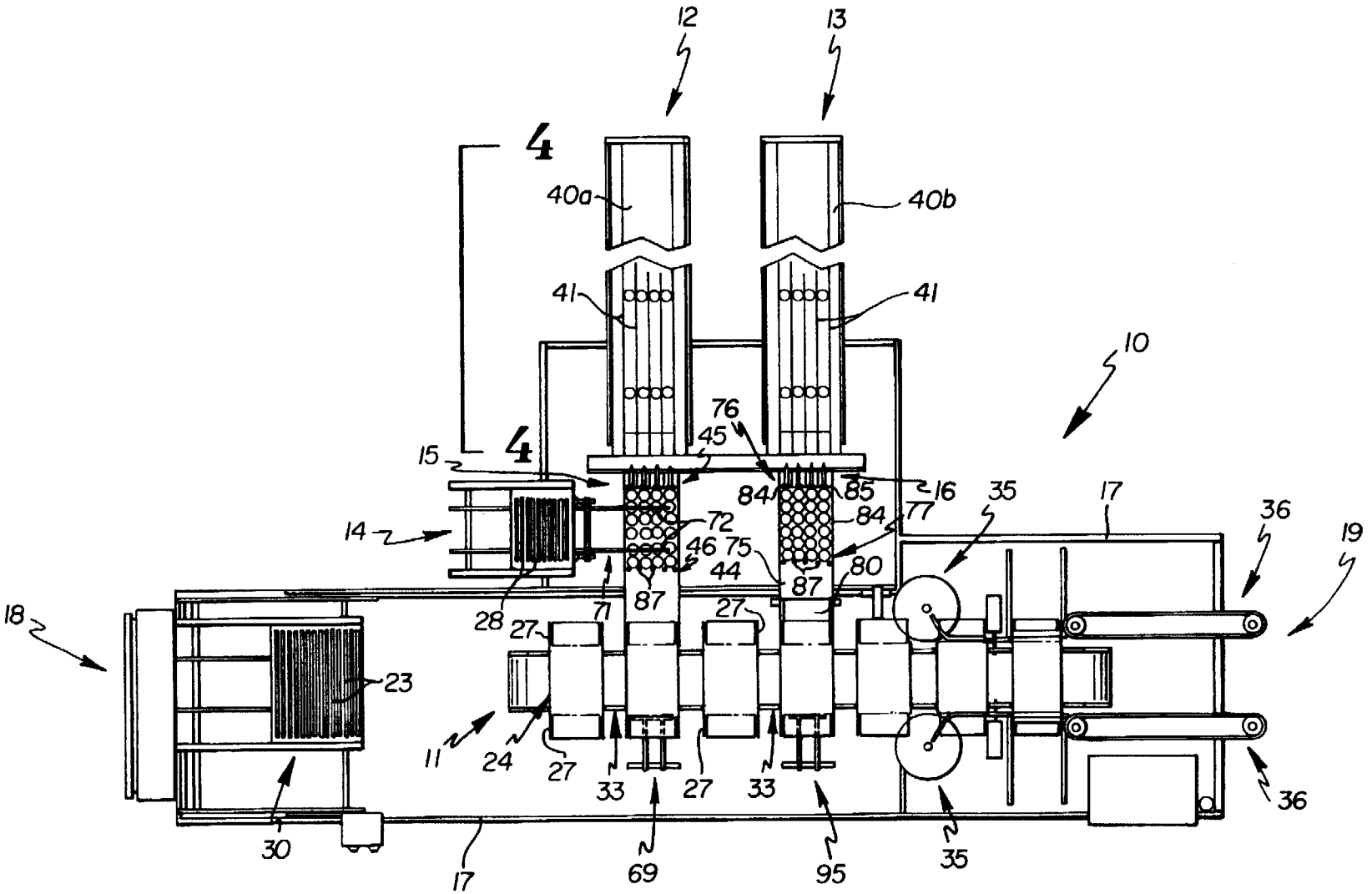
FIG. 2 is a top or plan view of the apparatus.
Figure 4:
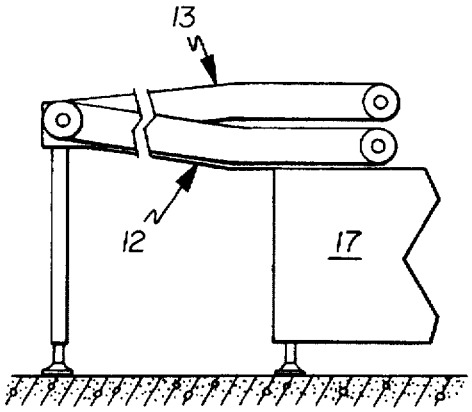
FIG. 4 is a side view of the article input section of the apparatus, taken along line 4—4 of FIG. 2.

Referring to FIGS. 1, 2 and 4, a preferred embodiment of the apparatus of the present invention is generally indicated by the reference numeral 10. The packaging apparatus or machine 10 is described below first in terms of its major structural and functional elements and then in terms of its specific structural elements which cooperate to perform a packaging function.

Figure 3:
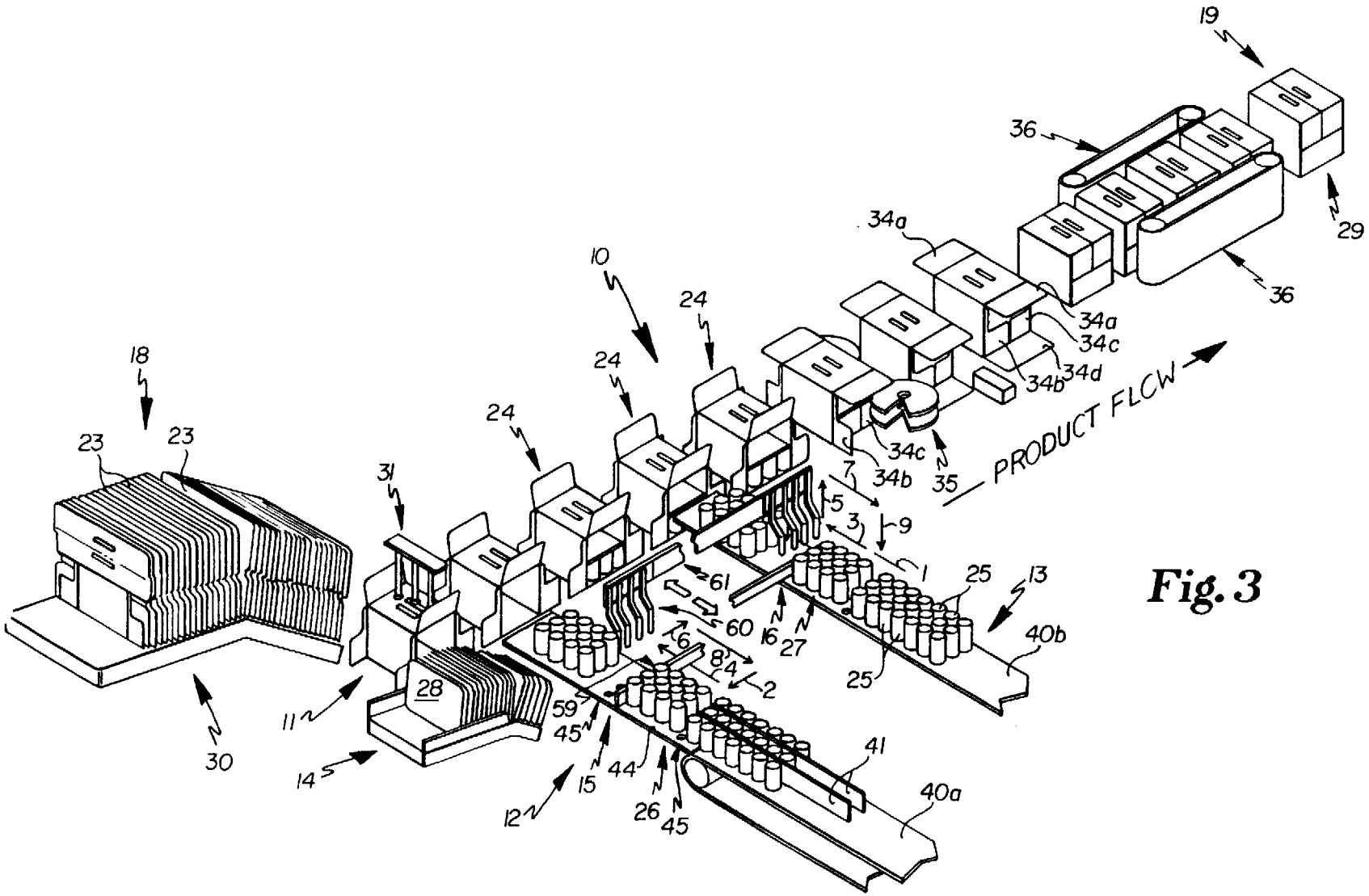
FIG. 3 is perspective view of portions of the apparatus.

Referring also to FIGS. 3 and 4, the packaging apparatus 10 basically comprises a central, longitudinally oriented, linear canon stream or line 11, a first or low article infeed stream or line 12, a second or high article infeed stream 13, a divider sheet feeder 14, a low group selecting and loading assembly 15, and a high group selecting and loading mechanism 16. These mechanisms are preferably supported by a unitary frame structure 17. The cannon line 11 and infeed article lines 12 and 13 are preferably synchronized conveyor based mechanisms. The carton stream 11 is disposed longitudinally and extends from an upstream end 18 to a downstream, output end 19. The article infeed streams 12 and 13 are oriented preferably perpendicularly and from the same side of the carton stream 11. The infeed lines 12 and 13 are staggered longitudinally along the carton line 11, the high infeed line 13 being disposed downstream with respect to the low line 12. Additionally, the article infeed lines 12 and 13 are disposed in vertically separate planes, the high line 13 being disposed at a higher level.

In operation, carton blanks 23 are erected into open ended cartons 24. Unmetered articles 24 on the input lines 12 and 13 are formed into groups, and the groups are loaded into erected cartons 24. In a stacked or double tier article processing mode, both the low article input line 12 and the high input line 13 are operational. The first or low group selecting and loading assembly 15 forms a first or low article sub-group 26 and loads it into a carton 24 on the carton line 11. The second or high low group selecting and loading assembly 16 forms a second or high article sub-group 27 and loads it into the carton 24 containing the low article sub-group 26. The high article sub-group 27 is slid over the low article sub-group 26 resident in the carton 24 to form a stacked article group inside the carton 24. Preferably, the divider sheet feeder 14 deposits a divider sheet 28 onto the top of the formed low article sub-group 26 prior to its being loaded into the carton 24. The divider sheet 28 provides a smooth, flat surface which facilitates sliding movement of the upper group 27 over the lower group 26. In a flat or single tier article group processing mode, only the low article input line 12 is operational. The first or low group selecting and loading assembly 15 forms the article sub-group 26 and loads it into a carton 24 on the carton line 11. In both stacked and flat processing modes, the loaded cartons 24 are transported downstream on the carton line 11 further processing and output as a filled, completed carton 29.

Referring also to FIGS. 6–14, the carton line 11 preferably comprises a carton blank magazine 30, a blank placement mechanism 31, and a canon conveyor 25. Top carton stabilizers or guides 37 may also be used. The upstream end of the conveyor 25 is disposed generally below the blank placer 31. The blank placer 31, for example a reciprocating or rotary placer, picks carton blanks 23 from the magazine 30 and places them on the conveyor 25. The conveyor 25 has a plurality of spaced lugs or flights 33 between which the erected cartons 24 are disposed. The cartons 24 are arranged so that their ends are disposed laterally or to the side with respect to the longitudinal axis of the carton line 11. The cartons 24 have open flaps 27*a–d* at each side. The conveyor 25 transports cartons 24 linearly, downstream past the group selecting and loading assemblies 15 and 16, a gluing and flap closing section 28, a compression section 36 and to the output end 19 of the assembly 10. Sections 28 and 36 operate to glue and close the flaps 27 of the cartons 25 once the article group or groups are fully loaded therein, and to hold the flaps closed for a sufficient time to allow the glue to set and hold the flaps 27 closed.

The article supply lines 12 and 13 each transport a plurality of unmetered articles 25. The lines 12 and 13 are oriented in a spatially parallel orientation with respect to each other, in separate vertical planes, and on the same side of the canon conveyance line 11. The lines 12 and 13 preferably approach the carton conveyance line 11 perpendicularly. The low line 12 is disposed at the level of a top, downstream run of carton conveyor 32, while the high line 13 is disposed immediately above the low line 12. Each line 12 and 13 includes a conveyor 40*a,b*, and one or more lane dividers 41 which orient the infed articles 25 into linear rows. The lane dividers 41 terminate at a predetermined point short of the respective selecting and loading system 15 and 16.

The low and high group selecting and loading mechanisms 15 and 16 are disposed at the ends of the low and high infeed lines 12 and 13 respectively, adjacent one side of the canon line 11. The low selection and loading mechanism 15 comprises a deadplate 44, a infeed line stop assembly 45, a pack pattern line stop assembly 46, a pack pattern staging bar assembly 47, and a loading arm assembly 48.

The deadplate 44 is aligned with and extends from the terminal end of the conveyor 40 to the carton line conveyor 32. It is disposed at the level of the top run surface of each conveyor 40 and 32. The deadplate 44 is preferably constructed of a polymeric material such as Nylon. It has a set of aligned apertures 52 disposed a predetermined distance from the forward edge of the deadplate 44 which cooperate and permit vertical movement of the infeed line stop assembly 45 therewith, and a set of aligned, and laterally elongated slots 53 which cooperate with the pack pattern line stop assembly 46. The length of the slots 53 permits adjustment of the pack pattern line stop assembly 46 to form various article group 26 sizes. The deadplate 44 is bounded on its lateral sides by guide rails 54 which maintain the pack pattern of the group 26 moving thereover.

The infeed line stop assembly 45 comprises a plurality of driven stop pins 55 which are vertically oriented and arranged in a line laterally across the deadplate 44, aligned with the first set of apertures 52 therein. The pins 55 have a predetermined diameter and cylindrical configuration, and are further oriented with respect to the infeed line 12 so that each pair of adjacent pins 55 will impede the forward progress of a row of articles 45 exiting the infeed line 12 when fully vertically upwardly extended. The pins 55 are connected to an actuation mechanism 56 which extends and downwardly retracts them at a predetermined time. The infeed line stop assembly 45 separates the trailing cans a group 26 from the leading cans of the infeed line.

The pack pattern line stop assembly 46 comprises a plurality of driven stop pins 57 which are vertically oriented and arranged in a line laterally across the deadplate 44, aligned with the set of slots 53 therein. The pins 57 have a predetermined diameter and cylindrical configuration, and are further oriented with respect to the infeed line 12 so that each pair of adjacent pins 57 will impede the forward progress of a row of articles 45 comprising an article group 26 when fully vertically upwardly extended. The pins 57 are connected to an actuation mechanism 58 which extends and downwardly retracts them at a predetermined time. The pack pattern line stop actuation mechanism 58 is synchronized with the infeed line stop assembly actuation mechanism 56. The position of the pins 57 extending though the slots 83 in the deadplate 75 control the depth, from three to six cans, of the pack pattern 26.

The pack pattern staging or retaining bar assembly 47 comprises an elongated bar 59 of predetermined dimensions and a cam driven actuation mechanism (not shown). The bar 59 is oriented laterally with respect to the deadplate 44. Referring to FIGS. 3 and 6–9, the actuation mechanism extends and retracts the bar 59 laterally over the deadplate 44 and further moves the bar 59 longitudinally forward and backwards over the deadplate 44 to control the movement of a formed article group 26. As is best shown in FIG. 3, movement of the bar 59 is limited to a predetermined horizontal plane. The pack pattern staging bar assembly actuation mechanism is synchronized with the actuation mechanism 56 and 58 of the infeed line stop pin and pack pattern line stop assemblies 45 and 46.

The horizontal/vertical loading arm assembly 48 comprises an arm assembly 60 of predetermined dimensions and a cam driven actuation mechanism 61. The arm assembly 60 is oriented substantially vertically with respect to and over the deadplate 44. Referring to FIGS. 3 and 6–9, the actuation mechanism 61 downwardly extends and upwardly retracts the arm assembly 60 with respect the horizontally top surface of the deadplate 44 and further moves the arm assembly 60 longitudinally forward and backwards over the deadplate 44 to control the movement of a formed article group 26. As is best shown in FIG. 3, movement of the arm assembly 60 takes place within a predetermined vertical planar region. The actuation mechanism 61 is synchronized with the actuation mechanisms of the pack pattern staging bar, infeed line stop, and pack pattern line stop assemblies 47, 45 and 46 respectively. The arm assembly 60 comprises a plurality of elongated bar members 62 attached to the actuation mechanism 61. Bar members 62 have a predetermined bent configuration with a vertical terminal segment 63 which is aligned with a row of articles 25 in a group 26, and contacts the trailing member 64 of such row. The lateral orientation of the bar 62 members and the number of bar members 62 is adjustable to accommodate various article sizes and group sizes and configurations. A divider sheet stabilizer 65 is preferably connected to the arm assembly. The stabilizer 65 is preferably a flexible tubular, looped structure which gently holds the divider 28 down and in place upon contact.

Figure 6:
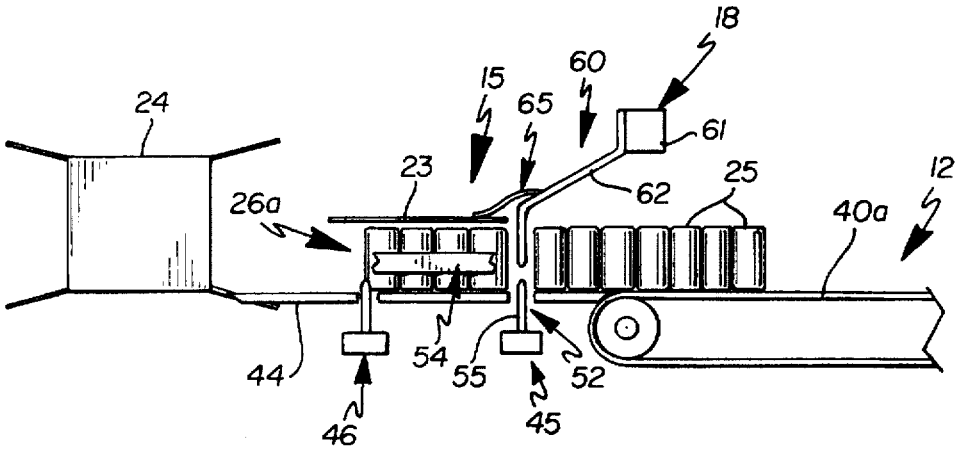
FIG. 6 is a side view of a portion of the apparatus wherein, during operation, a group of articles is formed from an input stream of articles.
Figure 7:
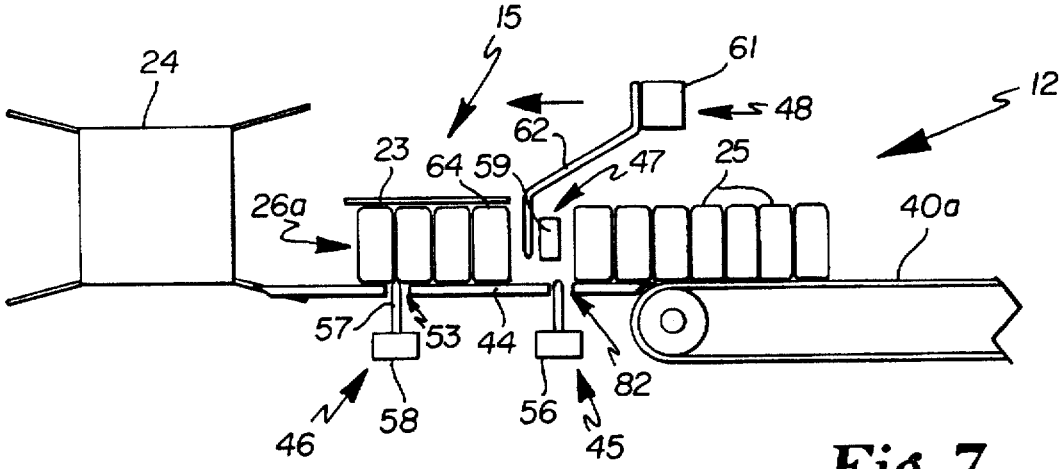
FIG. 7 is a side view of the portion shown in FIG. 6, wherein the group is being transported forwardly.
Figure 8:
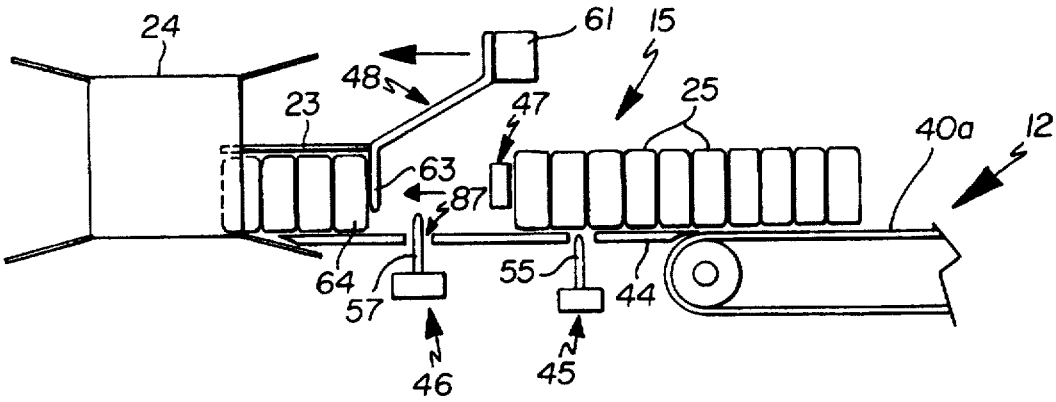
FIG. 8 is a side view of the portion shown in FIGS. 6 and 7, wherein the initial group is being further transported and loaded in a carton, and wherein a subsequent group is being formed.

Referring particularly to FIGS. 3 and 6–9, in operation, the various elements of the low group selection and loading assembly function as follows. FIG. 6 shows an initial stage wherein the infeed line stop pins 55 and pack pattern line stop pins 57 are extended. The loading arm 60 is disposed above the infeed line stop pins 55 and is downwardly extended. In this position, the surge of articles 25 on the infeed conveyor **40*a* is held back by the infeed line stop pins 55. A pre-processed group 26*a* is shown in FIGS. 6–9. Subsequently, referring to FIG. 7, the pack pattern line stop pins 57 are retracted, the loading arm 60 is advanced forward a predetermined distance (FIG. 3, Flow 1) and the pack pattern staging bar 59 is horizontally extended (Flow 2) into a gap created by the loading arm 60 moving forward. Where group 26*a* is present, the loading arm 60 urges the group 26*a* forward. Next, referring to FIG. 8, the line stop pins 55 retract, the loading arm 60 again advances (Flow 3), and the pack pattern staging bar 59 advances forward (Flow 4.). The pack pattern stop pins 57 then extend upwardly. Next, referring to FIG. 9, as the leading articles 66 contact the pack pattern stop pins 57, the loader arm 60 is upwardly retracted (Flow 5), the pack pattern staging bar 59 is horizontally retracted (Flow 6) and the line stop pins 55 extend between trailing articles 67 of the now formed group 26*b* and the terminal or leading articles 68 on the conveyor 40*a*. The loader arm 60 is rearwardly retracted (Flow 8) and the pack pattern staging bar 59 is retracted (Flow 9) as shown in FIG. 6 for further cyclical processing. During loading, a reciprocating hold back mechanism 69, shown in FIGS. 2 and 9, advances toward the group 26*a* through the open back side of the carton 24, and is preferably used to set a back limit on movement of the group 26*a*. The stop has a stepped face 70 which allows the leading edge of the divider pad 23 to extend over the leading edge of the article group 26*a*. The divider sheet 23 is subsequently pushed back by a related mechanism 95 aligned with the high group loading station 16 so that its opposite or trailing edge extends over the trailing edge of the article group 27*a*. The extended end is grasped by a pneumatic clamp edge on the ramp 80 to provide smooth transfer surface for the high article group 27 during loading. The extended trailing edge of the divider sheet 23** is subsequently folded down by downstream plow apparatus.

Figure 9:
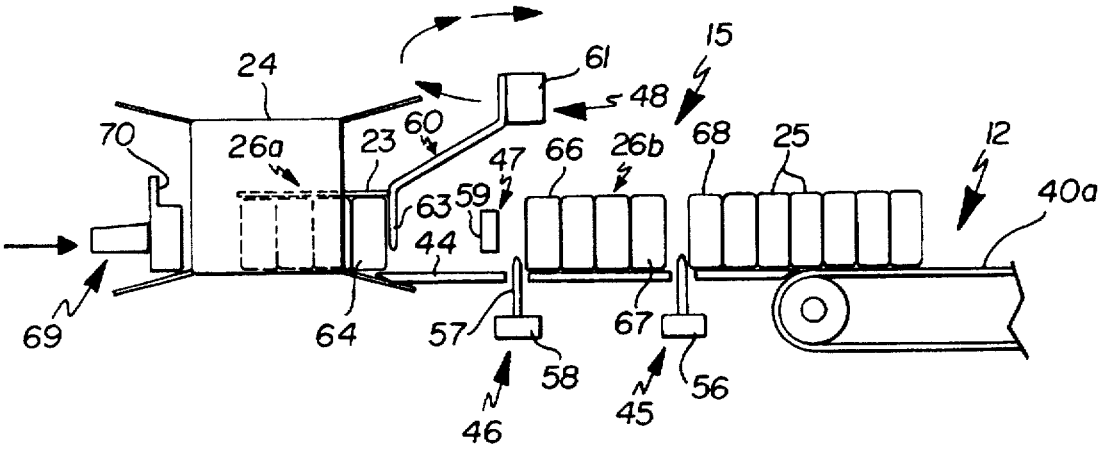
FIG. 9 is a side view of the portion shown in FIGS. 6–8, wherein the initial group is further being loaded in the carton, and wherein the subsequent group is fully formed.
Figure 10:
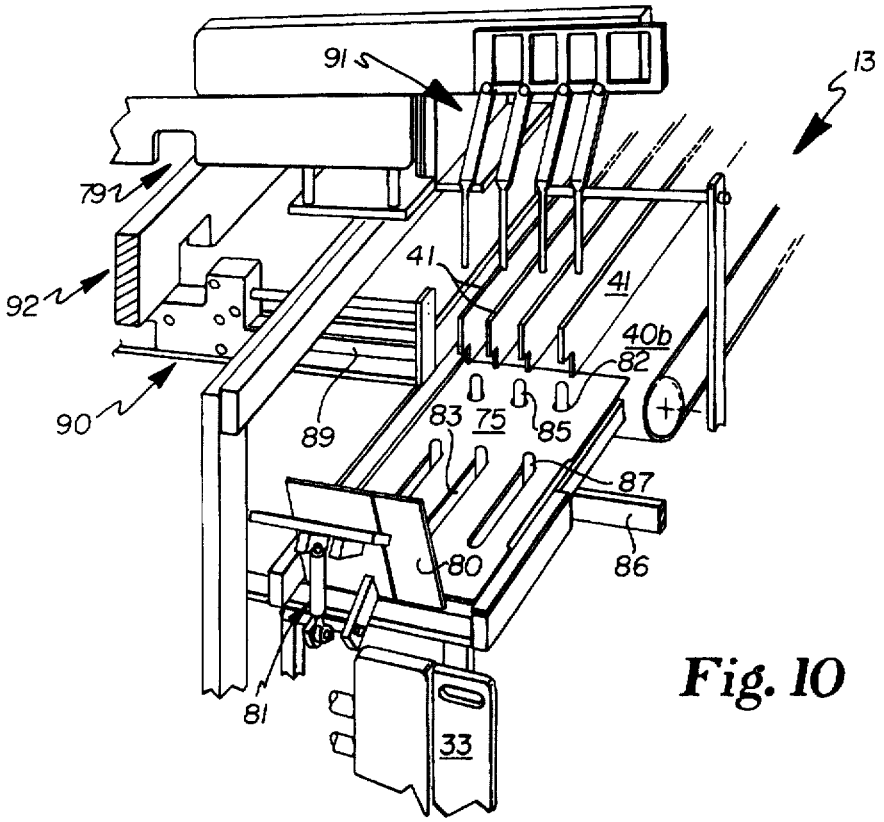
FIGS. 10–14 illustrate detailed sections of the apparatus.
Figure 11:
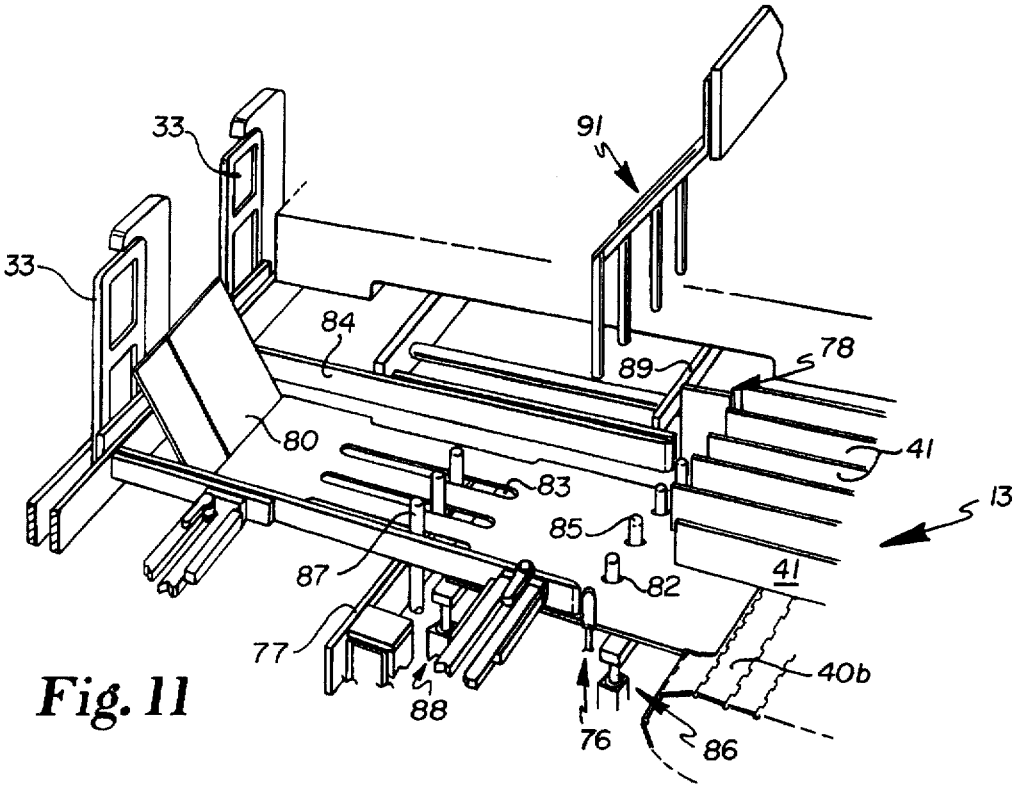
Figure 12:
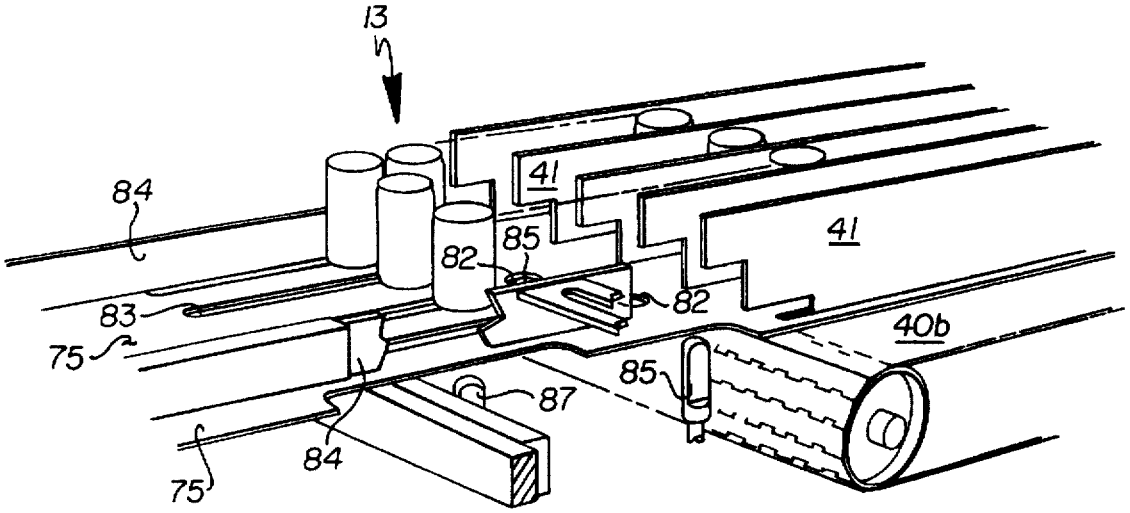
Figure 13:
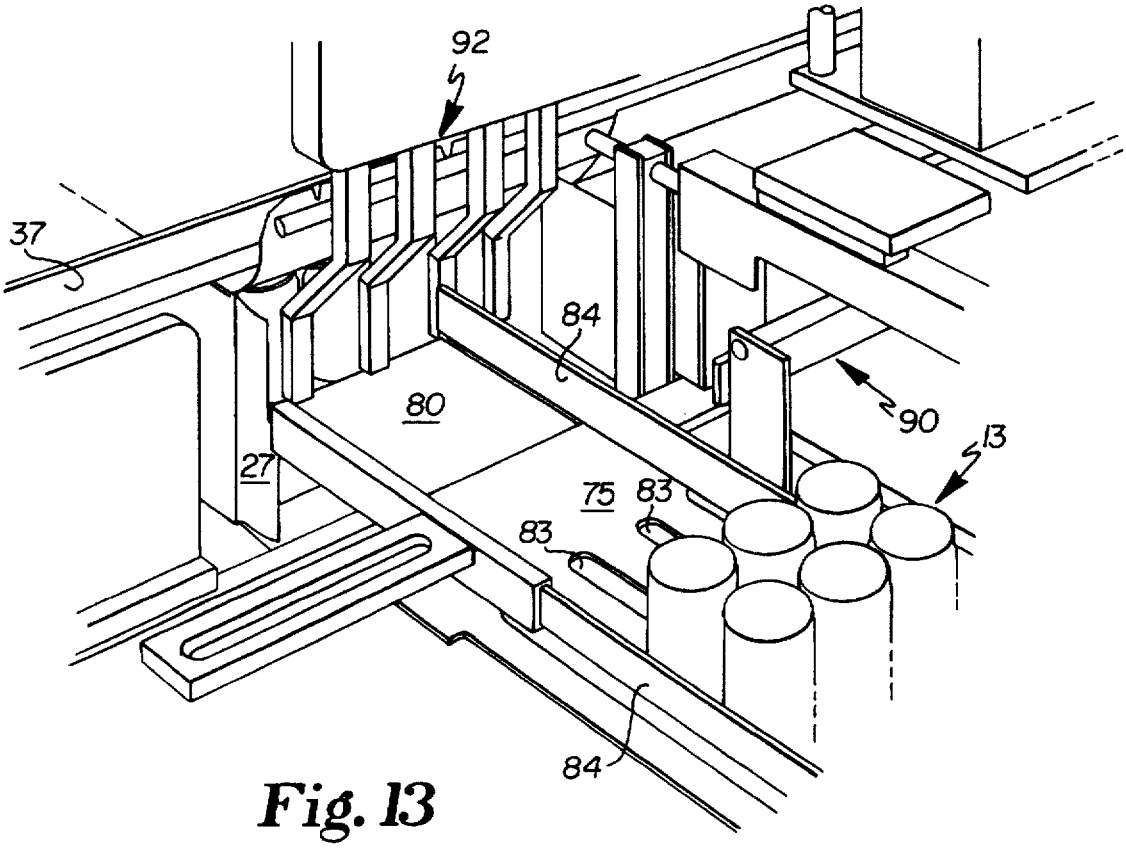
Figure 14:
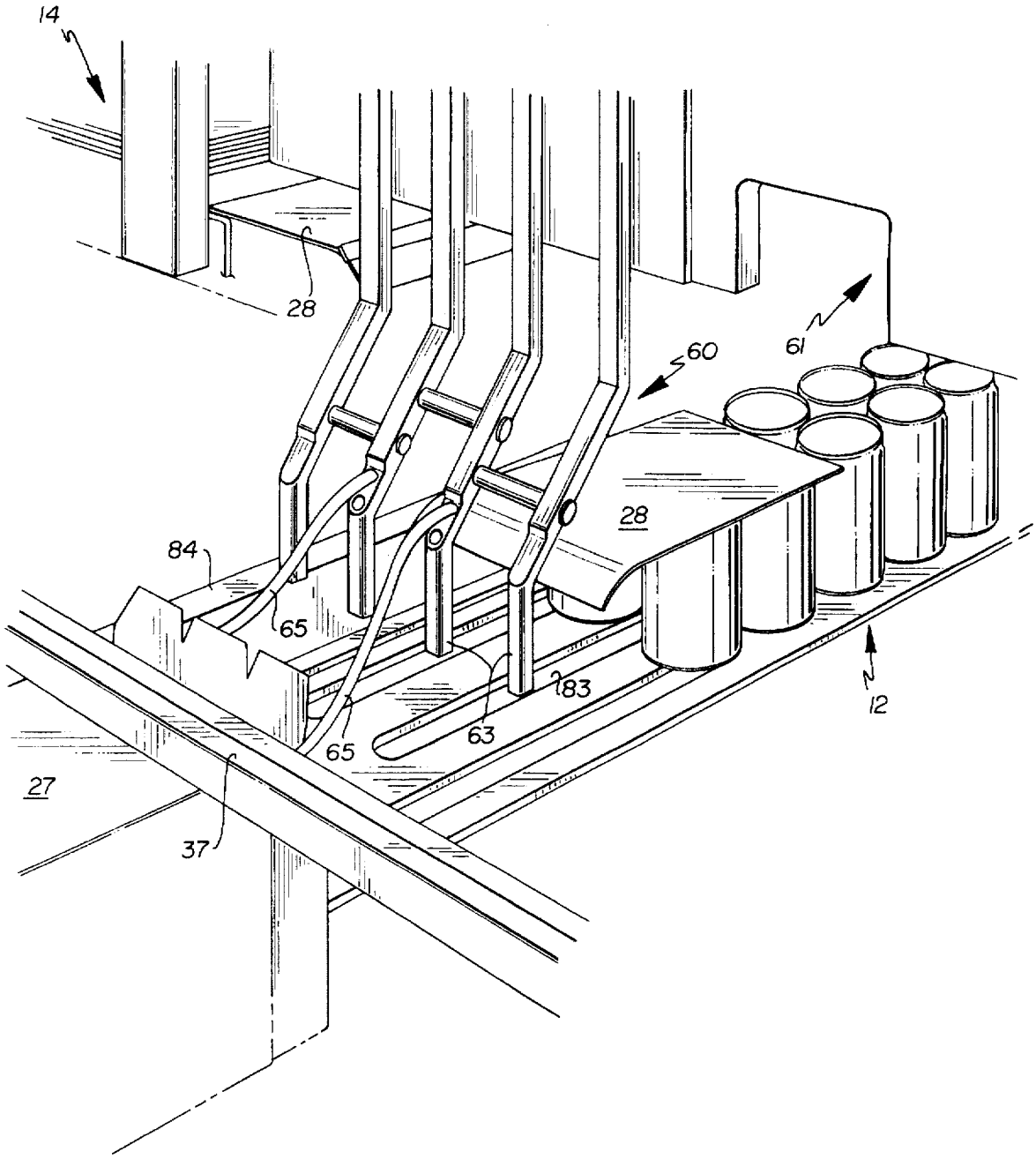

The divider sheet feeder 14 is disposed adjacent the low selecting and loading mechanism 15. The divider sheet feeder 14 preferably is a friction sheet feeder of the type manufactured by Stream Feeder, for example. Sheets 28 are disposed in a magazine portion of the feeder 14 and each sheet 28 is output from the feeder 14 horizontally and from the side onto a retractable holder mechanism 70. The holder mechanism 70, which preferably comprises a plurality of extendible and retractable rods or prongs 72, is subsequently retracted resulting in an individual sheet 28 being dropped onto the top surface of the low article group 15. Sheet feeding and dropping occurs after a group 26 is formed by the low group selection and loading assembly 15 as shown in FIGS. 9 and 6, respectively.

The high selection and loading mechanism 16 is structurally and functionally similar to the low selection and loading mechanism 15. It comprises a deadplate 75, an infeed line stop assembly 76, a pack pattern line stop assembly 77, a pack pattern staging bar assembly 78, a loading arm assembly 79, and an articulating loading ramp 80.

The deadplate 75 is aligned with and extends from the terminal end of the conveyor **40*b* to a point short of the carton line conveyor 32, where the loading ramp 80 is disposed. It is disposed at the level of the top run surface of conveyor 40*b* and above the level of conveyor 32. The loading ramp 80 provides a deadplate surface which the high group 27 is pushed across by the loader arm. The ramp is constructed and arranged to pivot up and away from the carton line 11, for example by an air cylinder 81, to permit canons 24 to be advanced forward on the carton line 11, and to pivot down and provide a horizontal sliding surface for the high group 27 when the carton 24 is stopped and aligned. The deadplate 75 also has two sets 82 and 83 of aligned apertures which cooperate with and permit vertical movement of the infeed line stop assembly 76 and pack pattern line stop assembly 77, respectively, therewith. The deadplate 75 is bounded on its lateral sides by guide rails 84 which maintain the pack pattern of the group 27 moving thereover. The infeed line stop assembly 76 comprises a plurality of stop pins 85 which impede the forward progress of a row of articles 76 exiting the infeed line 12 when fully vertically upwardly extended. The pins 85 are connected to an actuation mechanism 86 which extends and downwardly retracts them at a predetermined time. The pack pattern line stop assembly 77 comprises a plurality of stop pins 87 which impede the forward progress of a row of articles 76 comprising an article group 26 when fully vertically upwardly extended. The pins 87 are connected to an actuation mechanism 88 which extends and downwardly retracts them at a predetermined time. The pack pattern line stop assembly actuation mechanism 88 is synchronized with the infeed line stop assembly actuation mechanism 86. The pack pattern staging bar assembly 78 comprises an elongated bar 89 of predetermined dimensions and an actuation mechanism 90. The bar 89 is oriented laterally with respect to the deadplate 75. The pack pattern staging bar assembly actuation mechanism 90 is synchronized with the actuation mechanisms 86 and 88 of the infeed line stop pin and pack pattern line stop assemblies 76 and 77, respectively. The loading arm assembly 79 comprises an arm assembly 91 of predetermined dimensions and an actuation mechanism 92. The arm assembly 91 is oriented substantially vertically with respect to and over the deadplate 75. The actuation mechanism 92 is synchronized with the actuation mechanisms 90, 86 and 88 of the pack pattern staging bar, infeed line stop, and pack pattern line stop assemblies 78, 76 and 77** respectively.

The actuation mechanisms of the high group selection and loading mechanism 16 function to cyclically form and load high groups 27 into the cartons, preferably across the divider sheets 28, in the cartons 24. In addition to being synchronized with each other, they are synchronized with related structures of the low group selection and loading mechanism 15.

In summary, each loading mechanism 15 and 16 moves laterally across its respective infeed line 12 and 13, preferably at a right angle, at predetermined intervals to contact an article group 26 or 27 and move it from the line 12 or 13 into an aligned carton 17 disposed on the carton line 11. In a stacking article group processing mode, the low article group 26 is formed, a divider panel 28 from the divider sheet feeder 14 is optionally deposited on the top of the formed low article group 26, the group 26 is inserted into a carton 24, that carton 24 is transported downstream by the carton line 11 into alignment with the high loading mechanism 16 where the high group 27 is laterally and slidingly moved across the divider sheet 28 to form the stacked article group inside the carton 24. The filled cartons 24 are subsequently conveyed further downstream for ancillary processes. In a flat or single tier article processing mode, the high infeed line 13 and selection and loading system 16 are disabled. Only article groups 15 are inserted into flat cartons of any one of several well known designs (not shown), which are then transported downstream on the conveyor line 11 for gluing, flap tucking, compression and output.

Figure 5:
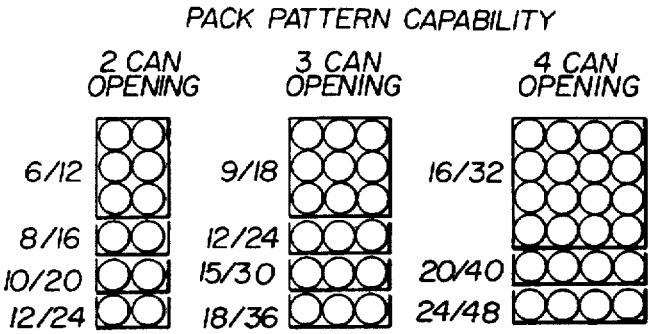
FIG. 5 is a chart showing various exemplary pack patterns provided by the apparatus for a particular can diameter.

FIG. 5 shows various pack patterns that may be formed by the apparatus 10 for beverage cans with a diameter in the range between 2.09 and 2.60 inches (53 and 66 mm.) and height between 3.0 and 7.0 inches (76.2 and 177.8 mm.). The pack patterns include two tier, stacked groups, as well as single tier of flat groups. Additional pack patterns may be achieved utilizing the apparatus and method of this invention depending upon the diameters of the articles. The apparatus 10 is fully adjustable to accommodate various article sizes, group configurations, and carton sizes and configurations.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A method for packaging articles, comprising the steps of:

(a) supplying a stream of packaging units, each of the packaging units having a first lateral side and a second lateral side;

(b) supplying at least one input stream of articles substantially perpendicularly with respect to the stream of packaging units;

(c) forming a flat, single layer article group at a terminal end of the at least one input stream of articles by using a set of line stop pins, a set of pack pattern line stop pins, and one staging bar for each stream, the staging bar having a reciprocating motion limited to a predetermined horizontal plane, wherein the step of forming an article group further includes the steps of:

(1) horizontally extending the staging bar into a gap behind a preformed article group and in front of a set of line stop pins;

(2) retracting the set of line stop pins;

(3) advancing the staging bar forward a predetermined distance toward the packaging unit;

(4) upwardly extending the set of line stop pins;

(5) horizontally retracting the staging bar behind the extended set of pack pattern pins; and (6) retracting the staging bar rearward for cyclical processing;

(d) inserting a reciprocating holdback mechanism into the second lateral side of a packaging unit to a predetermined position; and (e) substantially perpendicularly loading the article group into the packaging unit in the stream of packaging units using a loading arm to move the article group against the holdback mechanism, the loading arm having a reciprocating motion limited to a predetermined vertical plane, wherein the step of forming an article group further includes the steps of:

(1) downwardly extending the loading arm and engaging a preformed article group;

(2) retracting the set of pack pattern line stop pins;

(3) advancing the loading arm forward a predetermined distance toward the packaging unit;

(4) upwardly extending the set of pack pattern line stop pins;

(5) upwardly retracting the loader arm; and (6) retracting the loading arm rearward for cyclical processing;

whereby the steps of forming the article group, inserting the holdback mechanism, and loading the article group are synchronized with each other during the operation of a continuous motion cartoner.

2. The method of claim 1, wherein a pair of input streams of articles is supplied, a second flat, single layer article group being formed and loaded into the packaging unit, on top of the first article group disposed therein, whereby stacked article groups are formed in the packaging unit.

3. The method of claim 2, further comprising the step of depositing a divider sheet on top of the first article group prior to its being loaded in the packaging unit, the second article group being slid across the divider sheet.

4. The method of claim 3, wherein the first article group is selected from a first stream of articles disposed at a first vertical level, and the second article group is selected from a second stream of articles disposed at a second vertical level above the first vertical level, the first and second article groups being aligned with packaging units disposed and moving on the stream of packaging units, each first article group being laterally moved into a packaging unit at a predetermined point and from the first lateral side of the stream of packaging units, and each second article group being laterally moved onto the divider sheet at a second predetermined point and from the first lateral side of the stream of packaging units.

5. The method of claim 4, wherein the divider sheet is constructed of paperboard and has a thin, substantially flat, rectilinear configuration with a surface area substantially coextensive with that of a top surface of the first article group, and wherein the articles are beverage cans and wherein the packaging units are paperboard cartons with open ends bounded by flaps.

6. A method of forming a stacked article group within a packaging unit, comprising the steps of:

(a) supplying a stream of packaging units;

(b) supplying low and high streams of articles perpendicularly with respect to the stream of packaging units, each stream of articles having a terminal end;

(c) forming low and high flat, single layer article groups at the respective terminal ends of the low and high streams of articles by utilizing at least one set of stop pins and one staging bar for each stream;

(d) placing a support base on a top surface of the low article group;

(e) loading the low article group into a packaging unit on the packaging unit stream which is aligned with the low stream of articles by utilizing a loading arm;

(f) moving the loaded packaging unit on the stream of packaging units into alignment with the high article stream;

(g) offsetting the support base on the top surface of the low article group to create an extended trailing edge;

(h) clamping the trailing edge to hold the support base using an articulate loading ramp; and (i) loading the high article group into the loaded packaging unit over the support base by utilizing a loading arm.

7. A packaging apparatus, comprising:

(a) a packaging unit line transporting a stream of packaging units;

(b) at least one input article line transporting at least one stream of articles, each input article line having a terminal end region disposed adjacent the packaging unit line, the input article line approaching the packaging unit line substantially perpendicularly; and (c) an article group selection and loading mechanism disposed at the terminal end region of the at least one input article line, the article group selection and loading mechanism forming an article group and loading the article group in a packaging unit on the packaging unit line, the article group selection and loading mechanism further including:

(1) a deadplate disposed between the input article line and the packaging unit line for supporting articles moving across from the input article line to the packaging unit line, the deadplate having a plurality of apertures disposed therein in a predetermined configuration;

(2) at least one set of stops extendible above the deadplate through the apertures for selectively engaging and releasing articles on the deadplate;

(3) article group movement means disposed above the deadplate for controlling movement of the article group toward the packaging unit line, the article group movement means including:

(i) an extendible and retractable pack pattern staging bar which is horizontally and laterally arranged above the deadplate and which is longitudinally moveable with respect to the deadplate to lead and control the article group moving toward the packaging unit line; and (ii) an extendible and retractable loading arm assembly which is vertically arranged above the deadplate and which is longitudinally moveable with respect to the deadplate to follow and control the article group moving toward the packaging unit line; and (4) a reciprocating holdback mechanism for stopping the motion of the article group at a predetermined point in the packaging unit.

8. The apparatus of claim 7, wherein said packaging unit line is a rectilinear structure and comprises a conveyor having a plurality of spaced flights, the packaging unit line further having means to place packaging units between the flights, and wherein said at least one input article line is a rectilinear structure and comprises a conveyor having at least one article lane for transporting articles in a single file orientation.

9. The apparatus of claim 7, wherein the deadplate has a flat top surface with predetermined longitudinal and lateral dimensions and constructed of a low friction material, the apertures being disposed linearly and laterally.

10. The apparatus of claim 7, wherein the stops comprise:

(i) a plurality of infeed line stops arranged and disposed with respect to the deadplate so that they selectively impede and permit movement of articles from the at least one input article line from crossing the deadplate; and (ii) a plurality of pack pattern line stops arranged and disposed with respect to the deadplate so that they selectively impede and permit movement of the article group across the deadplate.

11. The apparatus of claim 7, wherein there are two input article lines constructed and arranged to package a stacked article group.

12. A packaging apparatus for loading stacked article groups within a packaging unit, comprising:

(a) a packaging unit line transporting a stream of packaging units;

(b) two input article lines, each input article line transporting a stream of articles, each input article line having a terminal end region disposed adjacent the packaging unit line, the input article lines approaching the packaging unit line substantially perpendicularly; and (c) a lower and a higher article group selection and loading mechanism disposed at the terminal end region of the two input article lines, each article group selection and loading mechanism forming an article group and loading the article group in a packaging unit on the packaging unit line, each article group selection and loading mechanism comprising:

(1) a deadplate disposed between the input article line and the packaging unit line for supporting articles moving across from the input article line to the packaging unit line, the deadplate having a plurality of apertures disposed therein in a predetermined configuration, wherein the deadplate of the higher article group selection and loading mechanism is an articulate loading ramp adapted for clamping a divider sheet that separates a lower and a higher article group;

(2) two sets of stops extendible above the deadplate through the apertures for selectively engaging and releasing articles on the deadplate, including:

(i) a plurality of infeed line stops arranged and disposed with respect to the deadplate so that they selectively impede and permit movement of articles from the at least one input article line from crossing the deadplate; and (ii) a plurality of pack pattern line stops arranged and disposed with respect to the deadplate so that they selectively impede and permit movement of the article group across the deadplate; and (3) an article group movement assembly disposed above the deadplate for controlling movement of the article group toward the packaging unit line including:

(i) an extendible and retractable pack pattern staging bar which is horizontally and laterally arranged above the deadplate and which is longitudinally moveable with respect to the deadplate to lead and control the article group moving toward packaging unit line; and (ii) an extendible and retractable loading arm assembly which is vertically arranged above the deadplate and which is longitudinally moveable with respect to the deadplate to follow and control the article group moving toward the packaging unit line; and (4) a reciprocating holdback mechanism located across the stream of packaging units opposite the deadplate and the loading arm assembly.

* * * * *